US006149151A

United States Patent [19]

Blanchard et al.

[11] Patent Number: 6,149,151

[45] Date of Patent: Nov. 21, 2000

[54] APPARATUS FOR THE SLOWING OF COPIES

[75] Inventors: Alain Blanchard; Dominique Boillot, both of Gouvieux; Daniel Calvez, Balaguy sur Therain; Robert Gaultier, Verneuil En Halatte; Herve Henry, Creil; Philippe Herda, Longueil Sainte Marie; Pierre Hoynant, Neuilly Sous Clermont; Emmanuel Lebeuf, Pontste Maxence, all of France

[73] Assignee: Heidelberger Druckmaschinen Aktiengesellschaft, Heidlelberg, Germany

[21] Appl. No.: 09/330,891

[22] Filed: Jun. 11, 1999

[30] Foreign Application Priority Data

Jun. 11, 1998 [FR] France ..... 98 07381

[51] Int. Cl.[7] ..... B65H 5/34; B65H 29/66

[52] U.S. Cl. ..... 271/270; 271/202

[58] Field of Search ..... 271/202, 312, 271/270; 493/916–936; 270/52.17, 21.1

[56] References Cited

U.S. PATENT DOCUMENTS 4,159,823 7/1979 Bryer et al. ..... 270/21
4,269,402 5/1981 Fischer et al. .
4,461,467 7/1984 Herb ..... 271/202
4,506,873 3/1985 Faltin ..... 270/46 X
4,516,759 5/1985 Kobler .
4,564,470 1/1986 Schmitt .
5,037,076 8/1991 Stäb ..... 27/42 X
5,037,365 8/1991 Breton .
5,102,111 4/1992 Reponty ..... 270/12
5,358,464 10/1994 Funk et al. ..... 493/320 X

*Primary Examiner*—Christopher P. Ellis
*Assistant Examiner*—Kenneth W Bower
*Attorney, Agent, or Firm*—Herbert L. Lerner; Laurence A. Greenberg; Werner H. Stemer

[57] ABSTRACT

An apparatus for the transport and slowing of folding copies in a folding machine. The folding copies are transported by belt groups, and the copies are removed from a surface of the copy-guiding cylinder by the belt groups. At least two belt groups are provided for transporting the folding copies. A belt group preceding a longitudinal-folding device is driven by a drive that is independent of the folding machine drive.

11 Claims, 5 Drawing Sheets

1
8
8.1
8.1
9
9.1
9.1
10
10.1
10.1
10.1
11
11
11
11
12
23
23
23
23
23
24
24
25
26

10
21
23
24
25
26
10.1
11
12
21.1
1

APPARATUS FOR THE SLOWING OF COPIES

BACKGROUND OF THE INVENTION

Field of the Invention

The invention relates to an apparatus for the slowing of copies which may be, for example, single-ply or multi-ply printed products which, after being delivered in an imbricated stream, are further treated in further-processing lines.

Published, European Patent Application EP 0 055 405 A1 discloses a belt zone for the transport and slowing of folding products. In the belt zone for the transport and slowing of folding products between two successive stations of a folding machine between a longitudinal-folding device and a delivery station, two successive sections driven at graduated speeds are provided. These consist in each case of an upper and a lower belt set, each with a plurality of parallel belts and each with at least one belt roller located at the front in the direction of transport and at the rear in the direction of transport. Of these, at least one of the belt rollers, located at the front in the direction of transport, of the faster-running section located at the rear in the direction of transport is mounted so as to be adjustable in terms of its height. According to this solution, guide tongues become unnecessary due to the fact that the sections of the belt zone that succeed one another in each case have belts laterally offset relative to one another at least by the amount of their width and their mutually confronting end regions are pushed one into the other in the manner of tines.

International Patent Application WO 94/25383 discloses a method and an apparatus for the correctly positioned takeover of folded signatures in folding machines. The takeover is carried out by a belt guide system on a gripper cylinder. Irrespective of the surface quality of the signatures, there is provision for continually detecting and recording the position of a predetermined signature leaving the belt guide system. At the same time, the instantaneous actual angular position of a gripper system provided for taking over the predetermined signature is detected and recorded, an electrical difference signal being formed in the event of a deviation from a desired angular position, and the gripper cylinder subsequently being brought into its desired angular position by drive devices. An apparatus is also proposed for this purpose.

Published, Non-Prosecuted German Patent Application DE 42 43 222 A1 relates to an apparatus for the transport and slowing of folding products. In order to slow folding products reliably, for example before they enter the second longitudinal-fold former, two belt groups in each case containing upper and lower belts are supplemented by a belt group containing upper belts. These belts are guided parallel to the lower belts of the first belt group at a distance which is greater than the product thickness.

French Patent FR 2 344 488 relates to a transport device for copies, by which the copies can be transported to a folding knife. The knife folder for folding a sheet stack supplied at a position under the folding knife by belt pairs runs at one-half the speed as compared with collecting and cross-folding units which precede in the folding machine of a web-fed rotary printing machine.

The knife folder is assigned its own belt system which runs more slowly than the belt system assigned to the preceding collecting or cross-folding units. Furthermore, two rollers of the upper belts of the belt system assigned to the knife folder form a wedge-like entry nip in relation to the lower belts. The rollers are of adjustable height, the wedge-like entry nip being at least as long as the maximum extent of the sheet stack in the conveying direction.

When folding copies are supplied to the second longitudinal-folding apparatus on the folding machine, the folding copies must be aligned at stops in such a way that the folding knife of the second longitudinal-folding device folds the folding copies exactly centrally at 90°. In order to achieve accurate alignment of the copies at a justifiable production rate, it is necessary to slow the conveying speed of the folding copies, the result of this being to mitigate the consequences of the impingement of the leading edge of the folding copies on the stops. It is necessary, moreover, to guide the folding copies in such a way that relative displacements cannot occur on the belts guiding them, which would considerably impair the quality of the products after they have passed through the second longitudinal-folding device.

SUMMARY OF THE INVENTION

It is accordingly an object of the invention to provide an apparatus for the slowing of copies which overcomes the above-mentioned disadvantages of the prior art devices and methods of this general type, in which to ensure guidance of the folding copies on both sides, one of the belt groups which guide the folding copies is capable of being driven independently of the folding machine.

With the foregoing and other objects in view there is provided, in accordance with the invention, an apparatus for transporting and slowing folding copies in a folding machine, including:

a copy-guiding cylinder having a surface for transporting folding copies;

at least two belt groups removing and further transporting the folding copies from the surface of the copy-guiding cylinder to a longitudinal-folding apparatus disposed downstream of one of the at least two belt groups; and an independent drive driving the one of the at least two belt groups preceding the longitudinal-folding apparatus.

The drive of one of the belt groups that guides the folding copies, by a drive that is independent of the remaining folding machine drive makes it possible to exert direct influence on the respective folding copies for the slowing of the folding copies that are conveyed onto the folding table below a folding knife. The slowing of the folding copies according to a weight and thickness of the copies can thereby be carried out. The independent drive by use of a high-torque electric motor, for example, allows a short braking and a short acceleration phase, so that the cycles of the motor can be adapted ideally to the conditions which are necessary for a highly accurate preparation and execution of a longitudinal fold.

In a further embodiment of the idea on which the invention is based, the belt groups include in each case upper belts and lower belts corresponding to these, so that, after copy alignment has taken place, relative movement can no longer occur in relation to the transport belts. The transition of the folding copies from the surface of the copy-guiding cylinder is assisted by product guides which, disposed in a stationary manner, engage into grooves on the outer surface of the copy-guiding cylinder.

In order to guide the folding copies, the belt groups in each case contain a multiplicity of upper belts and lower belts disposed next to one another, in order to prevent relative movement of the individual folding copies in relation to one another. The independent drive, which drives the belt group preceding the longitudinal-folding device, may drive either the upper belts of the belt group or its lower belts. The belt trains in each case disposed above or below them and located next to one another are likewise driven by the independent drive.

By use of the independent drive, which is preferably configured as a high-torque electric motor, the transport speed of the folding copies in the belt group preceding the longitudinal-folding device can be reduced to approximately 70% of the entry speed. Slowing the folding copies in this way makes it possible to prevent damage to the leading edge when the folding copies butt against the aligning elements.

The method for the transport and slowing of folding copies contains the following method steps:

- the removal of the folding copies from the surface of a copy-guiding cylinder by belt groups;
- the slowing of the folding copies on a belt group which precedes a longitudinal-folding device;
- aligning the conveyed folding copies via aligning stops disposed on the respective longitudinal-folding device; and
- accelerating the belt group equipped with an independent drive to the initial speed.

Other features which are considered as characteristic for the invention are set forth in the appended claims.

Although the invention is illustrated and described herein as embodied in an apparatus for the slowing of copies, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
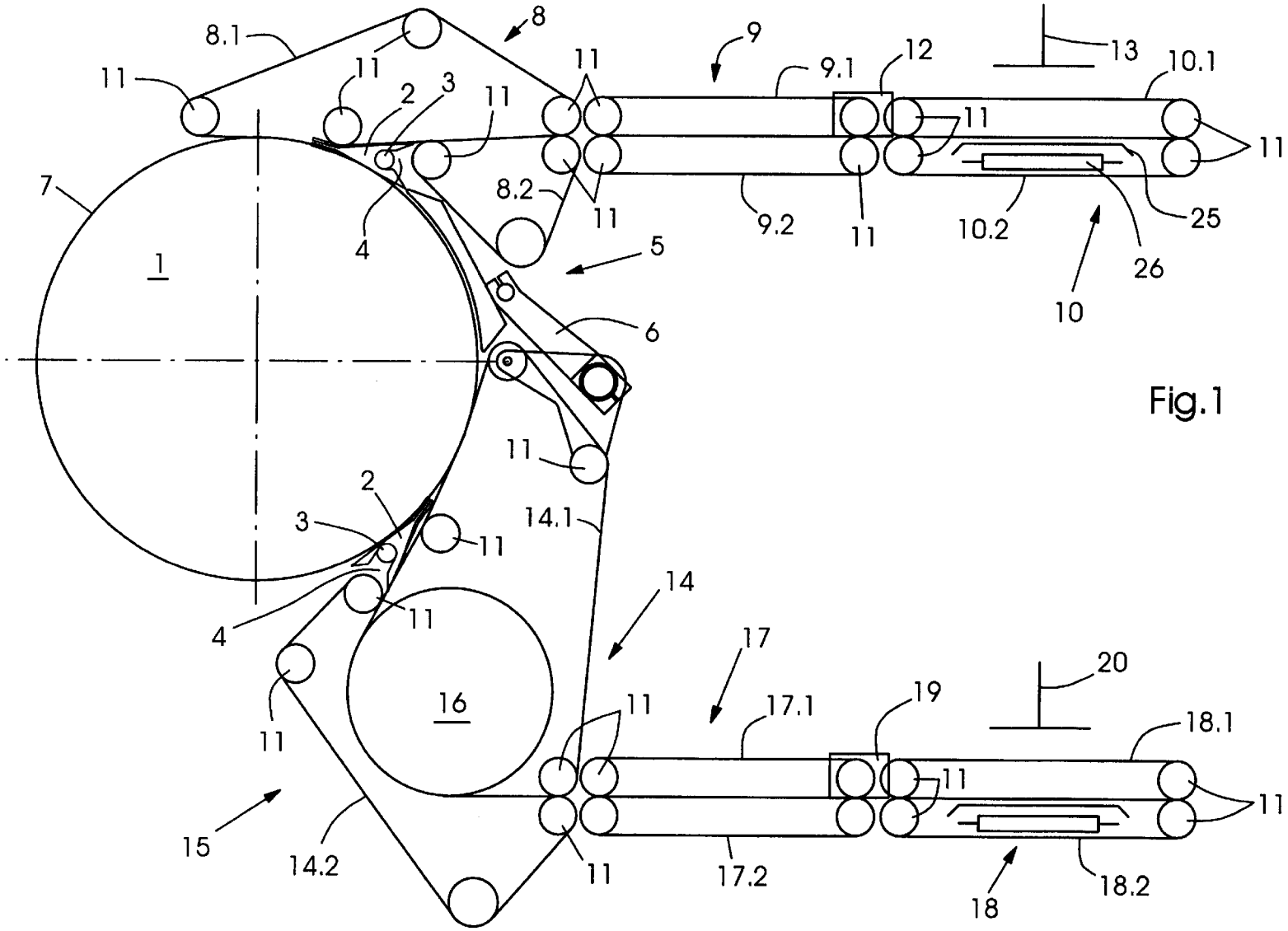
FIG. 1 is a diagrammatic, side-elevational view of a copy-guiding cylinder with an upper and a lower transport zone to a longitudinal-folding station, in each case with three belt groups, according to the invention.

In all the figures of the drawing, sub-features and integral parts that correspond to one another bear the same reference symbol in each case. Referring now to the figures of the drawings in detail and first, particularly, to FIG. 1 thereof, there is shown a side view of a copy-guiding cylinder 1 with an upper and a lower transport zone in each case to two longitudinal-folding devices 13, 20. The copy-guiding cylinder 1 transports, on its outer surface 1, cross-folded folding copies which can be supplied to the longitudinal-folding device 13 and 20 via the upper and the lower transport zones, respectively. The upper transport zone shown in FIG. 1 contains three upper belt groups 8, 9 and 10 which are separate from one another. A first upper belt group 8 includes upper belts 8.1 and lower belts 8.2, by which the cross-folded folding copies located on the circumference 7 of the copy-guiding cylinder 1 are removed. The upper and lower belts 8.1, 8.2 rotate on deflecting rollers 11. The removal of the folding copies from the circumference 7 of the copy-guiding cylinder 1 is assisted by product guides 2 that engage into grooves in the circumferential surface 7 of the copy-guiding cylinder 1. The product guides 2 introduce the leading edges of the folding copies into a nip between the upper and lower belts 8.1 and 8.2. The product guides 2 are disposed in a stationary manner and are received on simple holders 3, to which they can be fastened by snap fastenings 4. The circumferential surface 7 of the copy-guiding cylinder 1 is assigned a throw-on guide 5 which can be thrown onto the circumferential surface 7 and thrown off from the latter again via a pivoting lever 6. This depends primarily on the thickness of the copies located in each case on the circumference of the copy-guiding cylinder 1.

A further upper belt group 9 is provided downstream of the first upper belt group 8 of the upper transport zone. In contrast to the belt group 8 already described, this belt group 9 is provided with its own drive 12. The latter is preferably a high-torque electric motor, by which high accelerations or decelerations can be applied to the upper belts 9.1 and the lower belts 9.2. The drive 12, even though assigned only to the upper belt 9.1 in the illustration according to FIG. 1, also acts on the lower belt 9.2, corresponding to it, of the second upper belt group 9.

By use of the independent drive 12 in the form of a high-torque electric motor 12, the second upper belt group 9, which precedes the longitudinal-folding station 13 reproduced merely diagrammatically here, can be driven independently of the folding machine drive. Since only every second folding copy of the stream of folding copies delivered continuously by the copy-guiding cylinder 1 passes onto the transport zone consisting of the upper belt groups 8, 9 and 10, in each case a gap occurs in the upper transport zone between two successive folding copies and may be utilized for the braking of the folding copies and for the more accurate alignment of these which thereby becomes possible. This applies similarly to the lower transport zone that consists of lower belt groups 14, 17 and 18. The braking carried out in the second upper belt group 9 takes place to approximately 70% of the original conveying speed of the following copies. With folding copies braked in this way, it is readily possible for these to be aligned at stops within the longitudinal-folding device 13, without the copy quality being impaired.

The upper longitudinal-folding device 13, indicated merely diagrammatically here by a folding knife, may have, instead of the belt group 10 shown here, a folding table, below which are disposed folding rollers gripping the longitudinally folded copy. The folding rollers serve to assist the formation of the longitudinal fold and convey the folding copies, for example, in bucket wheels, from which the folding copies are then subsequently delivered.

The folding copies braked by the second upper belt group 9 are transported onto the folding table which transports the third upper belt group 10 and are aligned at stops provided there. The folding knife of the upper longitudinal-folding device 13 then forms, on the already cross-folded folding copies, the longitudinal fold, which is all the more accurate since the folding copies are accurately aligned.

Figure 5:
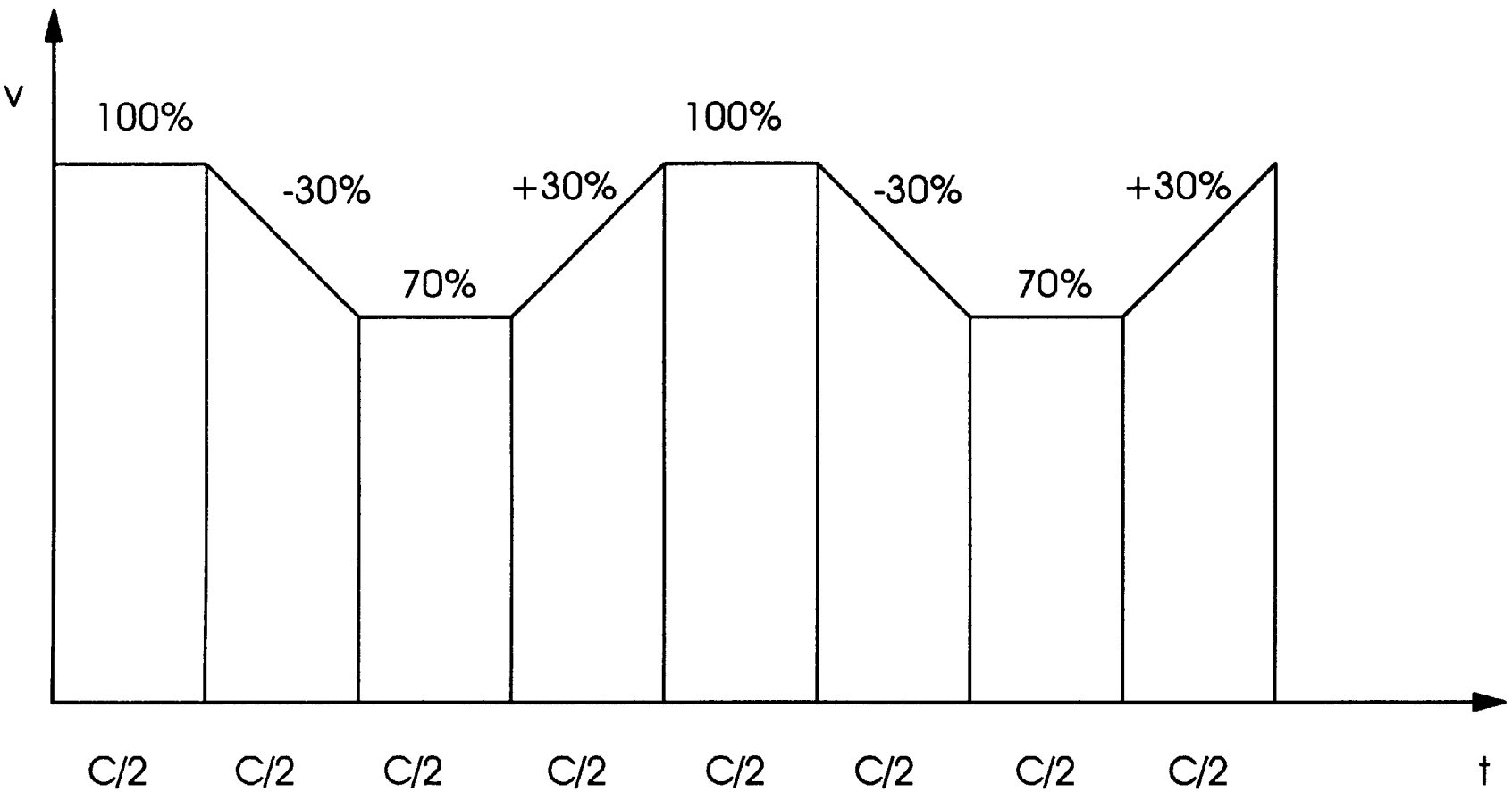
FIG. 5 is a graph showing a slowing and acceleration profile of the belt group preceding the longitudinal-folding device.

As soon as the respective folding copy to be supplied to the longitudinal-folding device 13 has left upper belts 9.1 or lower belts 9.2, the drive 12 of the second upper belt group 9 is accelerated to the initial speed again (cf. the graph in FIG. 5, in which two cycles are illustrated).

Every second folding copy is conveyed into the upper transport zone by the copy-guiding cylinder 1, while the copies remaining on the circumferential surface 7 of the copy-guiding cylinder 1 pass the pivotable product guide 5 and are led into the lower transport zone via the lower stationary product guide 2. The stationary product guide 2 is likewise provided with the snap fastening 4 and fastened to the holder 3. The lower belt group 14 of the lower transport zone includes upper belts 14.1 and lower belts 14.2 guided around the deflecting rollers 11 which transfer folding copies to the second lower belt group 17. This, in turn, is likewise equipped, in a similar way to the second belt group 9 in the upper transport zone, with a drive 19 which makes it possible to operate the second lower belt group 17 independently of the remaining folding machine drive.

After the deflection of the cross-folded folding copies are removed from the copy-guiding cylinder 1, they pass from the first lower belt group 14 into the second lower belt group 17 by being deflected at a deflecting roller 16. In a similar way to the upper transport zone, the second lower belt group 17 is equipped with the drive 19 that is independent of the folding machine drive. By the drive 19, the upper belts 17.1 and the lower belts 17.2 can be driven in acceleration and deceleration, independently of the folding machine drive, by utilizing the gaps, already described above, between the folding copies. The second lower belt group 17, too, is located upstream of the lower longitudinal-folding device 20 that is indicated diagrammatically here by a folding knife. A third lower belt group 18 includes, here, an upper belt 18.1 and a lower belt 18.2 that rotate about the deflecting rollers 11. It would be just as easily necessary to dispose a folding table on which the folding copies are conveyed after they have been braked by the second lower belt group 17 to approximately 70% of the value of their initial speed (cf. FIG. 5). After the folding copies have left the upper and lower belts 17.1, 17.2 of the second lower belt group 17, they are accelerated to the initial speed again by the drive 19 and, in the next slowing cycle, brake the subsequent folding copy.

Figure 2:
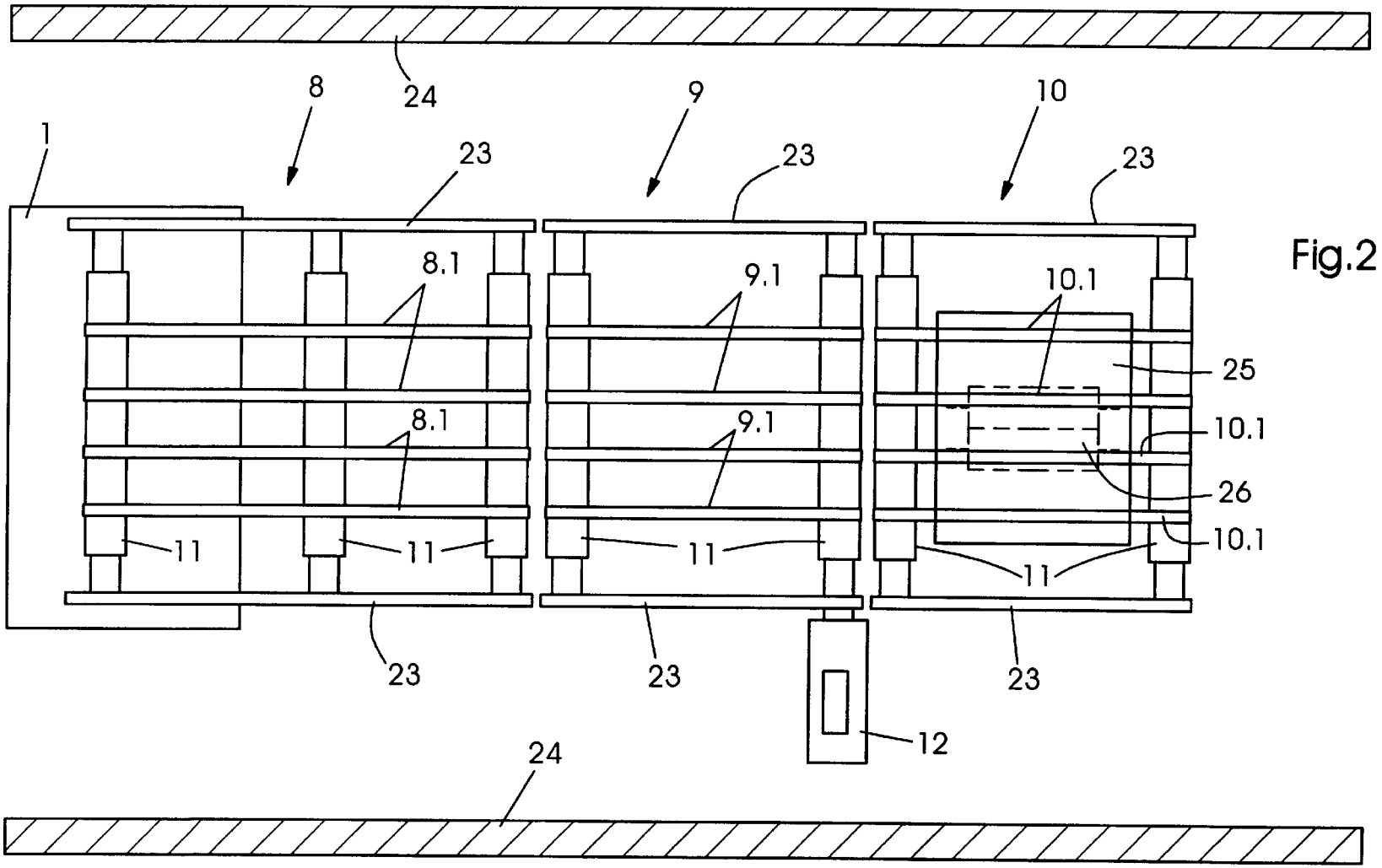
FIG. 2 is a top plan view of the illustration according to FIG. 1.

FIG. 2 shows a top view of the upper transport zone according to FIG. 1.

Provided in side walls 24 of the folding machine, which are reproduced merely diagrammatically here, are frame-like elements 23 in which the respective deflecting rollers 11 for the upper belts 8.1 of the first upper belt group 8 are mounted. The first upper belt group 8 is provided above the copy-guiding cylinder 1. The first upper belt group 8 is followed by the second upper belt group 9, in which the upper belts 9.1 rotate, likewise at a distance from one another, on the deflecting rollers 11.

Although FIG. 2 shows the third upper belt group 10, the latter may also be replaced by a folding table, on which stops for aligning the oncoming folding copies are provided. Located below the upper belts 8.1, 9.1 and 10.1 which are the first, second and third, as seen in the top view, are the lower belts 8.2, 9.2 and 10.2 which correspond to these, but which are covered, here, by the upper belts and therefore cannot be seen. As may also be gathered from FIG. 2, the drive 12 is located laterally on the second upper belt group 9.

Figure 3:
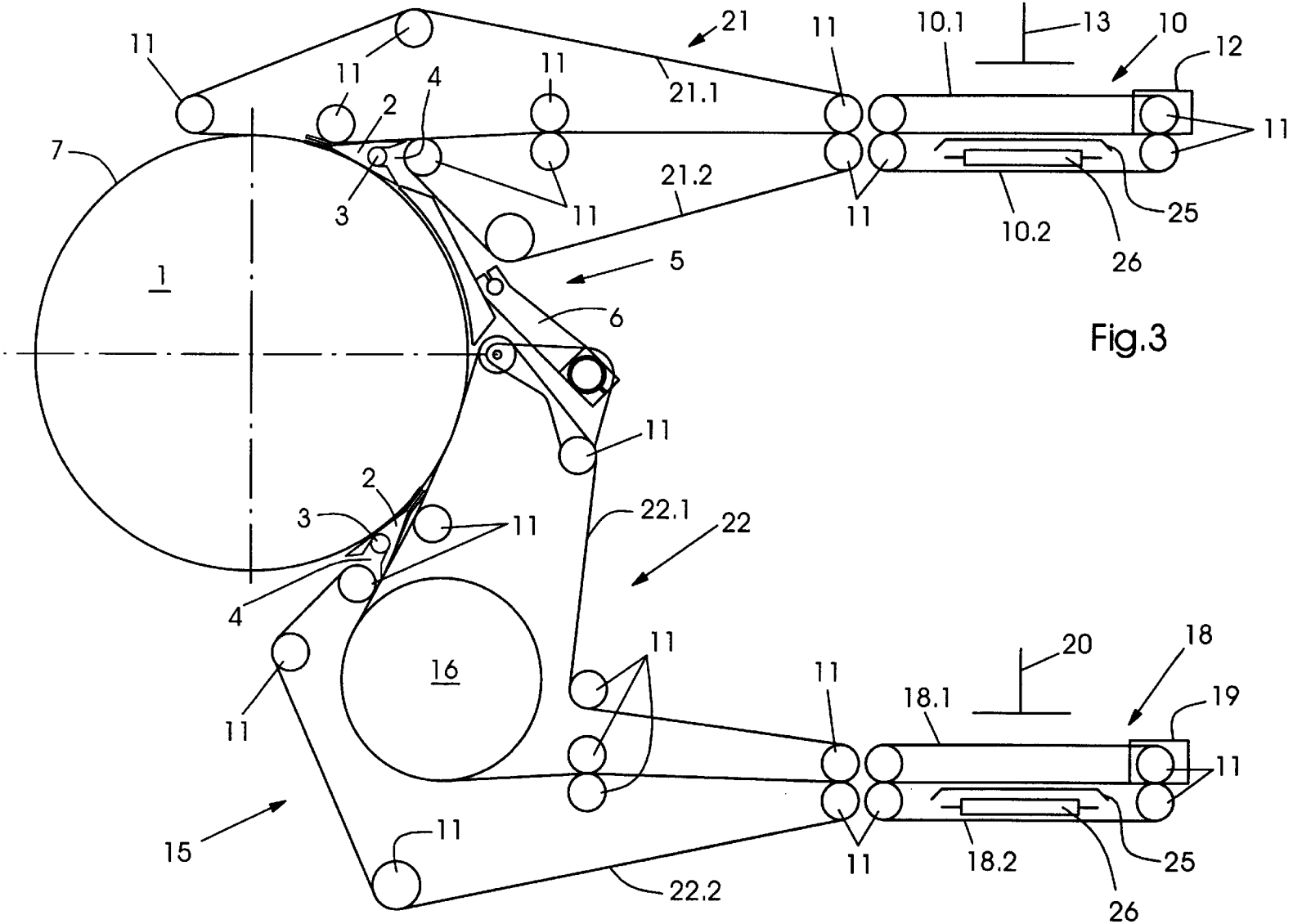
FIG. 3 is a side-elevational view of the copy-guiding cylinder with a transport zone in the longitudinal-folding devices, the transport zone consisting in each case of two belt groups.

FIG. 3 shows a modified configuration of the transport zones to the longitudinal-folding devices 13, 20, the transport zone being assigned to the copy-guiding cylinder 1.

In this embodiment, in each case the first and second belt groups 8, 9 and 14, 17 are combined to form a single modified belt group 21, 22 in each case. The modified belt groups 21, 22 in each case include upper and lower belts 21.1, 22.1 and 21.2, 22.2 and can be driven by the independent drives 12, 19. The upper and lower belts 21.1, 22.1; 21.2, 22.2 rotate on the deflecting rollers 11, the modified belt groups 21, 22 preceding the respective longitudinal-folding device 13,20, so as to brake the folding copies to approximately 70% of the initial speed before they enter the respective longitudinal-folding device 13, 20.

In the embodiment according to FIG. 3, the pivotable product guide 5 is located between the upper and the lower transport zones. And located in each case above and below the product guide 5 is the stationary product guide 2, with the aid of which the cross-folded folding copies are delivered to the upper and lower transport zones respectively. The respective upper and lower belts 21.1, 21.2; 22.1, 22.2 in each case rotate about the deflecting rollers 11 and can be driven in each case by the independent drives 12 and 19. The respective independent drive 12, 19 acts on the upper and lower belts of the two modified belt groups 21, 22 illustrated in FIG. 3, in order to avoid relative speeds between these which would make correct copy alignment impossible.

In this exemplary embodiment, too, the independent drives 12, 19 are preferably configured as high-torque electric drives. The drives 12, 19 brake the folding copies to be delivered to the longitudinal-folding device 13, 20 to approximately 70% of the initial speed, before the folding copies, aligned to stops, are longitudinally folded by the respective longitudinal-folding devices 13, 20.

In the configuration shown in FIG. 3, too, the belt group 10 or 18 below the longitudinal-folding device 13, 20 may be replaced by a folding table, on which the braked and aligned folding copy is longitudinally folded and subsequently further processed.

Figure 4:
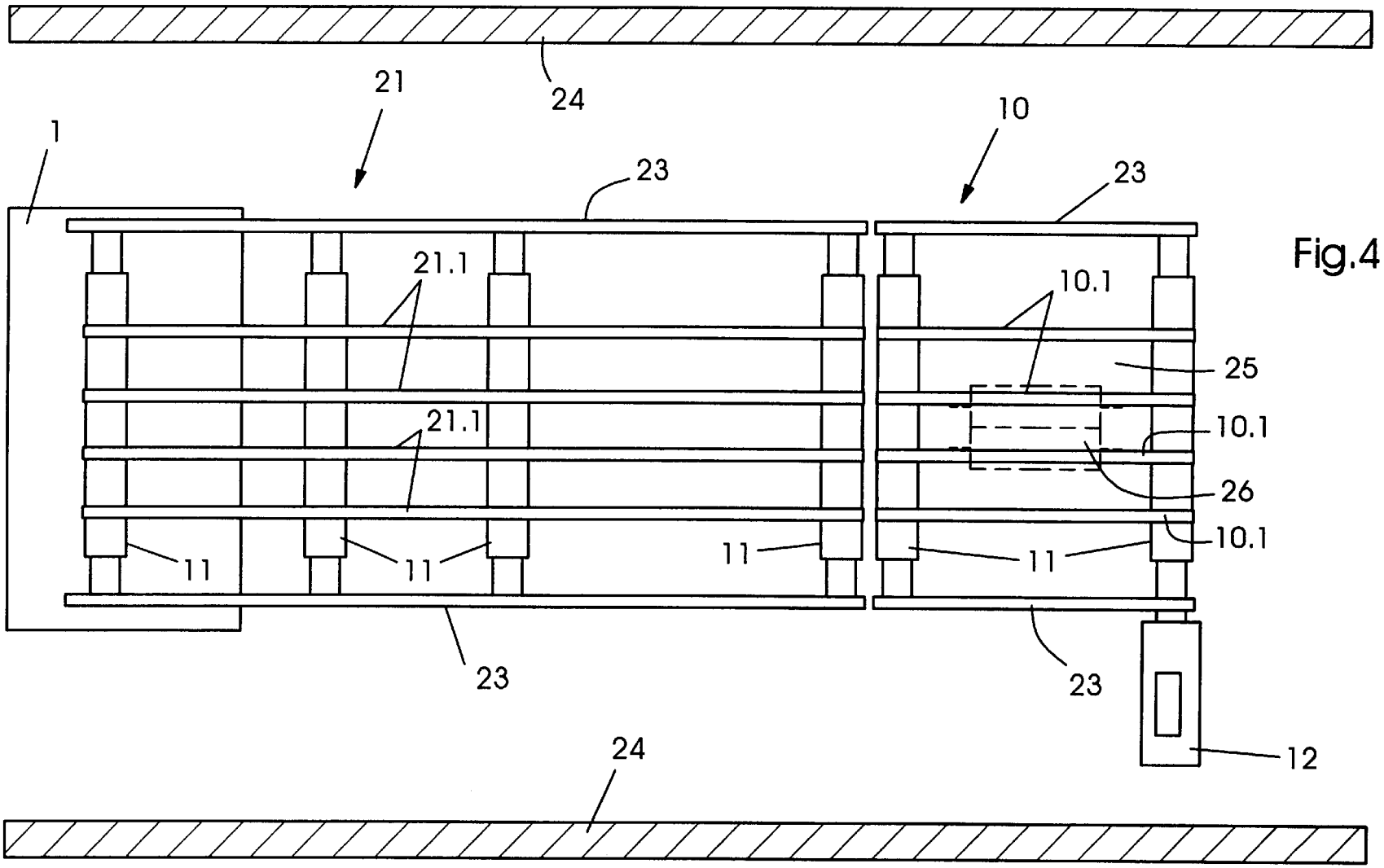
FIG. 4 is a top plan view of the illustration according to FIG. 3.

FIG. 4 shows a top view of the modified invention according to FIG. 3. Here too, it can be seen that the upper belts 21.1 received in the framework 23 and 10.1 of the upper belt groups 10 and 21 are located at a distance from one another, so as to support the folding copies uniformly.

FIG. 5 shows the acceleration and slowing profile that can be achieved by the independent drive 12, 19 of the belt groups 9, 17, 21 and 22. Starting from an initial speed of 100%, the respective upper and lower belts are decelerated linearly to 70% of the initial speed. After the folding copies have been transferred to the longitudinal-folding device 13 or 20, the upper and lower belts are accelerated to 100% of the initial speed again. The graph according to FIG. 5 illustrates two complete speed-change cycles for the belt groups 9, 17, 21 and 22 in each case preceding the longitudinal-folding devices 13 and 20.

We claim:

1. An apparatus for transporting and slowing folding copies in a folding machine, comprising:

a copy-guiding cylinder having a surface for transporting folding copies;

at least two belt groups removing and further transporting the folding copies from said surface of said copy-guiding cylinder to a longitudinal-folding apparatus disposed downstream of one of said at least two belt groups; and an independent drive driving said one of said at least two belt groups preceding the longitudinal-folding apparatus.

2. The apparatus according to claim 1, wherein each of said at least two belt groups have upper belts and lower belts.

3. The apparatus according to claim 1, wherein said one of said at least two belt groups preceding said longitudinal-folding device brakes the folding copies to be conveyed to 70% of an entry speed into said one of said at least two belt groups.

4. The apparatus according to claim 1, including a throw-on guide associated with said surface of said copy-guiding cylinder.

5. The apparatus according to claim 1, including product guides guiding the folding copies from said surface of said copy-guiding cylinder to said at least two belt groups.

6. The apparatus according to claim 5, wherein said surface of said copy-guiding cylinder has grooves formed therein and said product guides run in said grooves.

7. The apparatus according to claim 1, wherein said at least two belt groups each contain a multiplicity of upper belts and lower belts disposed next to one another.

8. The apparatus according to claim 7, wherein said independent drive drives said upper belts of said one of said at least two belt groups preceding said longitudinal-folding device.

9. The apparatus according to claim 8, wherein said independent drive drives said lower belts disposed in each case opposite said upper belts driven by said independent drive.

10. A method for transporting and slowing folding copies, which comprises:

removing folding copies from a surface of a copy-guiding cylinder to and by belt groups;

slowing a velocity of the folding copies on a belt group of the belt groups that precedes a longitudinal-folding device;

aligning the folding copies at aligning stops disposed on the longitudinal-folding station; and accelerating the belt group to an initial speed via an independent drive driving the belt group.

11. The method according to claim 10, which comprises braking the folding copies to approximately 70% of the initial speed during the slowing step.

* * * * *